US007491038B2

(12) United States Patent
Hyeon

(10) Patent No.: US 7,491,038 B2
(45) Date of Patent: Feb. 17, 2009

(54) RECIPROCATING COMPRESSOR

(75) Inventor: Seong-Yeol Hyeon, Changwon (KR)

(73) Assignee: LG Electronics Inc., Seoul (KR)

( * ) Notice: Subject to any disclaimer, the term of this patent is extended or adjusted under 35 U.S.C. 154(b) by 355 days.

(21) Appl. No.: 10/539,581

(22) PCT Filed: Oct. 24, 2003

(86) PCT No.: PCT/KR03/02262

§ 371 (c)(1),
(2), (4) Date: Jun. 17, 2005

(87) PCT Pub. No.: WO2005/040611

PCT Pub. Date: May 6, 2005

(65) Prior Publication Data

US 2006/0057000 A1 Mar. 16, 2006

(51) Int. Cl.
*F04B 35/04* (2006.01)
*F01B 31/00* (2006.01)

(52) U.S. Cl. ..... 417/417; 92/130 D; 92/131

(58) Field of Classification Search ..... 417/417, 417/363; 92/130 D, 130 C, 131
See application file for complete search history.

(56) References Cited

U.S. PATENT DOCUMENTS 2,801,045 A * 7/1957 Philipp ..... 417/363
3,248,044 A * 4/1966 Parker ..... 417/372
3,334,808 A * 8/1967 Parker et al. ..... 417/372
6,435,842 B2 * 8/2002 Song ..... 417/363
6,793,470 B2 * 9/2004 Song et al. ..... 417/417
2001/0043870 A1 * 11/2001 Song ..... 417/363
2003/0156956 A1 * 8/2003 Park et al. ..... 417/416
2003/0170128 A1 * 9/2003 Song et al. ..... 417/363

FOREIGN PATENT DOCUMENTS

CN 1443280 A 9/2003
JP 11-37065 A 2/1999
WO WO-02/079649 A1 10/2002
WO WO-02/095233 A1 11/2002

* cited by examiner

*Primary Examiner*—Charles G Freay
(74) *Attorney, Agent, or Firm*—Birch, Stewart, Kolasch & Birch, LLP

(57) ABSTRACT

A reciprocating compressor comprises a reciprocating motor (30) disposed in a casing (10), and generating a driving force; a compression unit (40) for sucking, compressing, and discharging gas by the driving force of the reciprocating motor (30); a resonant spring unit (50) for providing a reciprocating movement of the reciprocating motor (30) with a resonant movement; and at least two spring supporting frame (22,23) by which the resonant spring unit (50) is supported, wherein one of the spring supporting frames (22) is inserted into another spring supporting frame (23) for being coupled with each other. Accordingly, since an initial location of the piston (42) can be readily adjusted, a production process is simplified in producing a reciprocating compressor, and thus its productivity can be improved.

7 Claims, 4 Drawing Sheets

RECIPROCATING COMPRESSOR

TECHNICAL FIELD

The present invention relates to a reciprocating compressor, and particularly to a reciprocating compressor capable of improving its productivity by simplifying a fabrication process.

BACKGROUND ART

In general, a reciprocating compressor is an apparatus for sucking, compressing and discharging gas while a piston reciprocates in a cylinder.

As shown in FIG. 1, a conventional reciprocating compressor includes a casing 110 having a gas suction pipe 112 and a gas discharging pipe 114; a reciprocating motor 130 disposed in the casing 110 for generating a driving force; a compression unit 140 for sucking, compressing and discharging gas by the driving force of the reciprocating motor 130; a resonant spring unit 150 for providing a reciprocating movement of the reciprocating motor with a resonant movement; and a frame unit 120 for supporting the reciprocating motor 130, the compression unit 140 and the resonant spring unit 150 respectively.

The reciprocating motor 130 includes an outer stator 131; an inner stator 132 disposed at a certain air gap between itself and an inner circumference of the outer stator 131; and a magnet paddle 133 formed with a magnet 134 disposed between the outer stator 131 and the inner stator 132, thus to be linearly reciprocated by electromagnetic interaction of the outer and inner stators 131 and 132, and the magnet 134.

The compression unit 140 includes a cylinder 141 having an inner space; a piston 142 disposed in the inner space of the cylinder 141, connected with the magnet paddle 133 of the reciprocating motor 130 to be linearly reciprocated, and, with this reciprocating movement, varying a volume of a compression space (P) in the cylinder 141; a suction valve 143 mounted at a front side of the piston 142 (hereinafter, a side where gas is sucked will be referred to a rear, and a side where compressed gas is discharged to a front), and operated according to pressure in the compression space (P) for opening or closing a suction flow (F) of gas; and a discharging valve 144 installed at a front of the cylinder 141 for opening or closing a discharge of the compressed gas.

The frame unit 120 includes a first frame 121 mounted at a front side of the reciprocating motor 130 and the cylinder 141; a second frame 122 connected with the first frame 121 for supporting the outer stator 131 of the reciprocating motor 130 with the first frame 121; and a third frame 123 connected with the second frame 122 for receiving and supporting the resonant spring unit 150 with the second frame 122.

The resonant spring unit 150 includes a spring seat panel 151 disposed between the second frame 122 and the third frame 123, connected with the piston 142 to be linearly reciprocated; a first spring 152 disposed between the second frame 122 and the spring seat panel 151, and shrunk when the piston 142 moves frontward and elongated when the piston moves rearward; a second spring 153 disposed between the third frame 123 and the spring seat panel 151, and elongated when the piston 142 moves frontward and shrunk when the piston 142 moves rearward.

As shown in FIG. 2, the second frame 122 is formed as a disc shape, and supports the first spring 152. The third frame 123 is formed as a cylindrical shape, and includes a cylindrical portion 123*b* receiving the first and second springs 152 and 153 and the spring seat panel 151 therein; a spring supporting portion 123*c* extended from the rear side of the cylindrical portion 123*b* in an inner circumferential direction thereof, and supporting the second spring 153; and a flange portion 123*a* extended from a front side of the cylindrical portion 123*b* in an outer circumferential direction of the cylindrical portion 123*b*, and fixed at a surface of the second frame 122.

Herein, a spacer 160 is interposed between the second frame 122 and the flange portion 123*a* of the third frame 123. The spacer 160 is to set an initial location of the piston 142, and, according to a thickness of the spacer 160, a location of the piston 142 in the cylinder 141 is varied.

Operations of the conventional reciprocating compressor configured as above will now be described. When an electric power is applied to the reciprocating motor 130, the magnet paddle 133 is linearly reciprocated by electromagnetic interaction of the outer stator 131, the inner stator 132 and the magnet 134. According to this, the piston 142 connected with the magnet paddle 133 is linearly reciprocated in the cylinder 141, and thus varies a volume of the compression space (P). Accordingly, by change of the volume of the compression space (P), gas is sucked into the compression space (P), compressed, and discharged, and a series of these processes is repeated. At this time, since the first and second springs 152 and 153 supported between the second frame 122 and the third frame 123 provide the reciprocal movement of the piston 142 with a resonant movement, effect of the linear and reciprocal movement of the piston 142 becomes greater.

In the fabrication process of the conventional reciprocating compressor, an additive spacer 160 is inserted between the second frame 122 and the third frame 123 so that an initial location of the piston 142 can be adjusted in consideration of a stroke of the piston 142. According to the thickness of the spacer 160, the location of the piston 142 is adjusted from a dotted line to a solid line of FIG. 2.

However, in the structure for adjusting an initial location of a piston of the conventional reciprocating compressor as above, after determining a thickness of the spacer 160 and assembling the second and third frames 122 and 123, it can be determined whether the initial location of the piston 142 has been properly set or not. So, in case that the thickness of the spacer 160 has been determined inadequately, or a planning location of the piston is changed by production tolerance of the reciprocating compressor, the reciprocating compressor has to be disassembled, and reassembled with repeating the fabrication process.

DISCLOSURE OF THE INVENTION

Therefore, it is an object of the present invention to provide a reciprocating compressor capable of simplifying its fabrication process and thus improving productivity by readily adjusting an initial portion of a piston in fabricating a reciprocating compressor.

To achieve the above object, there is provided a reciprocating compressor comprises a reciprocating motor disposed in a casing, and generating a driving force; a compression unit for sucking, compressing, and discharging gas by the driving force of the reciprocating motor; a resonant spring unit for providing a reciprocating movement of the reciprocating motor with a resonant movement; and at least two spring supporting frames by which the resonant spring unit is supported, wherein one of the spring supporting frames is inserted into another spring supporting frame for being coupled with each other.

MODES FOR CARRYING OUT THE PREFERRED EMBODIMENTS

Hereinafter, a preferred embodiment of a reciprocating compressor according to the present invention will now be described with reference to accompanying drawings.

Figure 1:
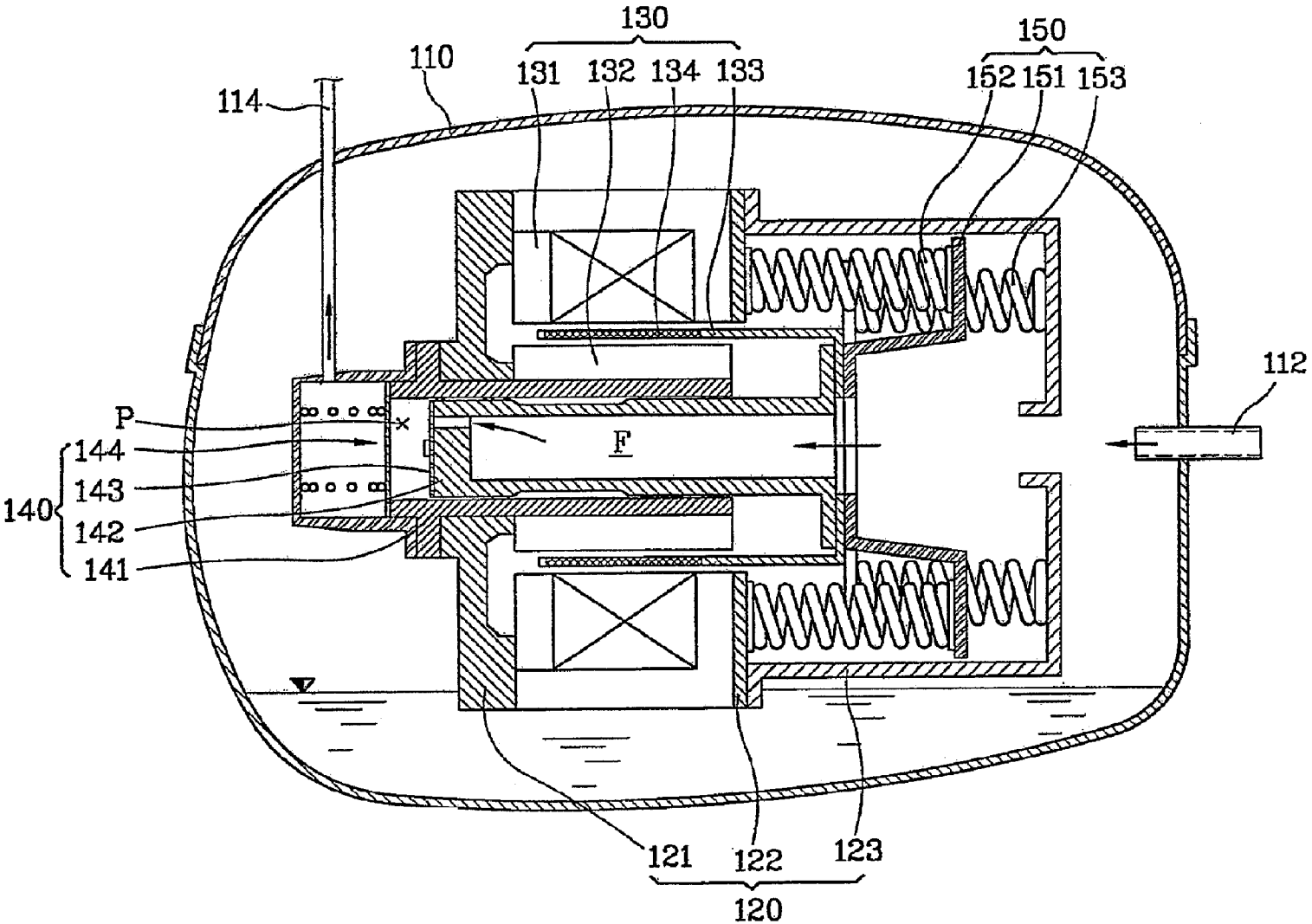
FIG. 1 is a sectional view of the conventional reciprocating compressor.
Figure 2:
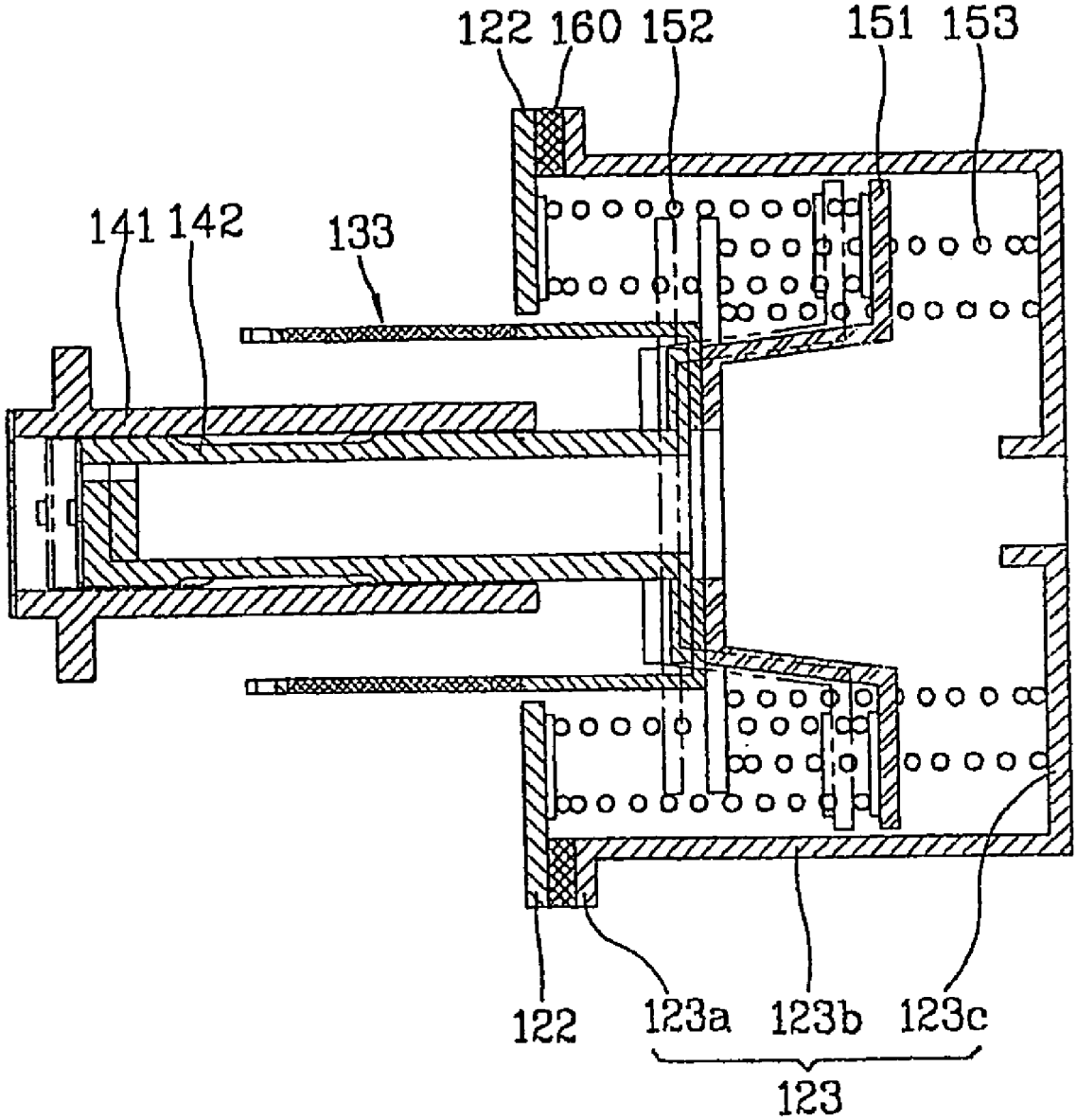
FIG. 2 is a schematic view showing a state of setting an initial location of a piston in the conventional reciprocating compressor.
Figure 3:
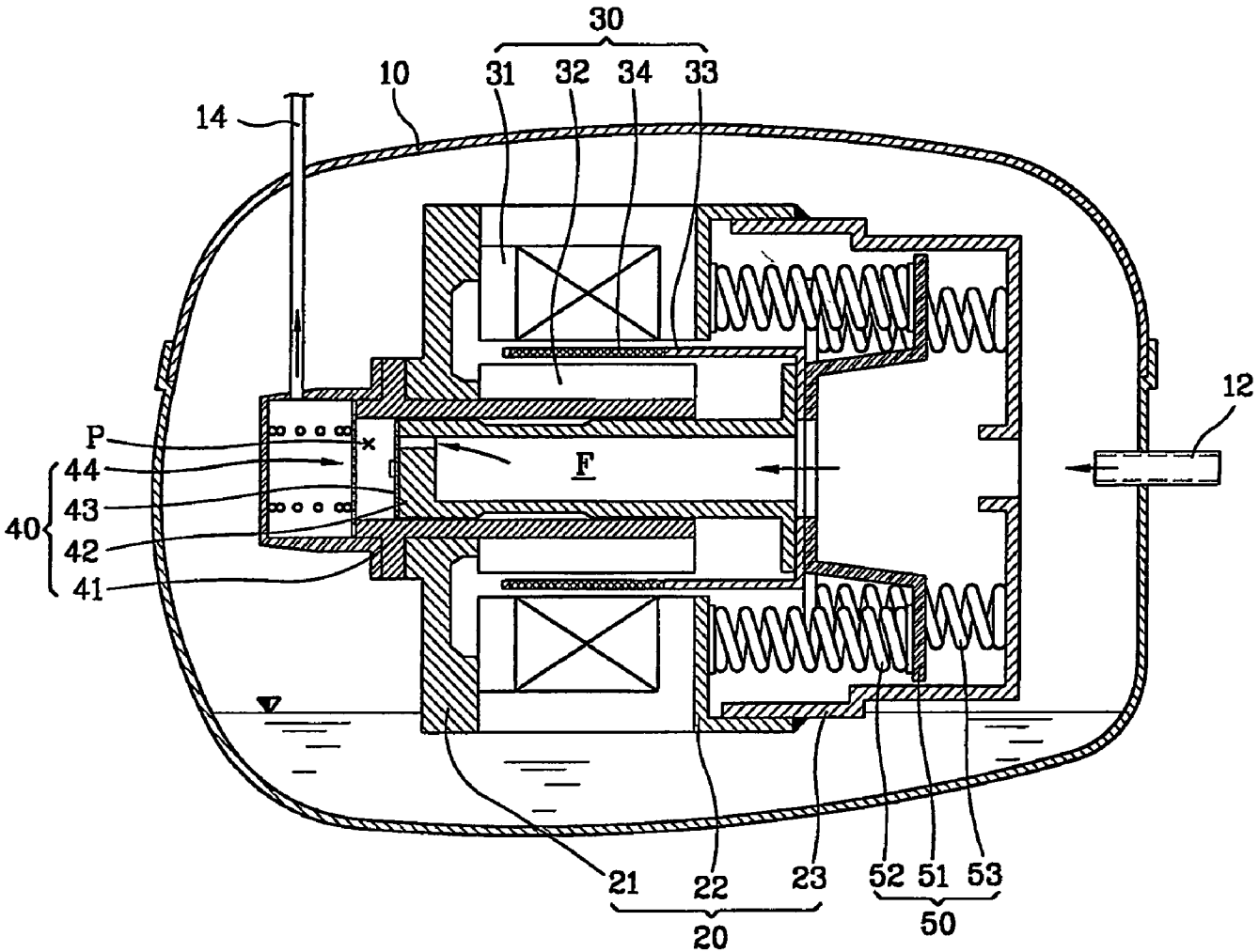
FIG. 3 is a sectional view showing a reciprocating compressor according to the present invention.

As shown in FIG. 3, the reciprocating compressor according to the present invention includes a casing 10 having a gas suction pipe 12 and a gas discharging pipe 14; a reciprocating motor 30 disposed in the casing 10, and generating a driving force; a compression unit 40 for sucking, compressing, and discharging gas by the driving force of the reciprocating motor 30; a resonant spring unit 50 for providing a reciprocating movement of the reciprocating motor 30 with a resonant movement; and a frame unit 20 for supporting the reciprocating motor 30, the compression unit 40 and the resonant spring unit 50.

The reciprocating motor 30 includes an outer stator 31; an inner stator 32 disposed at a certain air gap between itself and an inner circumference of the outer stator 31; and a magnet paddle 33 formed with a magnet 34 disposed between the outer stator 31 and the inner stator 32, thus to be linearly reciprocated by an electromagnetic interaction of the outer and inner stators 31 and 32 and the magnet 34.

The compression unit 40 includes a cylinder 41 having an inner space; a piston 42 disposed at the inner space of the cylinder 41, connected with the magnet paddle 33 of the reciprocating motor 30 thus to be linearly reciprocated, and, with this movement, varying a volume of a compression space (P) in the cylinder 41; a suction valve 43 mounted at a front side of the piston 42 (hereinafter, a side where gas is sucked will be referred to a rear, and a side where compressed gas is discharged to a front.), and operated according to pressure in the compression space (P) for opening or closing a suction flow (F) of gas; and a discharging valve 44 installed at a front of the cylinder 41 for opening or closing a discharge of the compressed gas.

The frame unit 20 includes a first frame 21 mounted at front sides of the reciprocating motor 30 and the cylinder 41; a second frame 22 connected with the first frame 21 for supporting the outer stator 31 of the reciprocating motor 30 with the first frame 21; and a third frame 23 connected with the second frame 22 for receiving and supporting the resonant spring unit 50 of the piston 42 with the second frame 22.

The resonant spring unit 50 includes a spring seat panel 51 disposed between the second frame 22 and the third frame 23, connected with the piston 42 to be linearly reciprocated; a first spring 52 disposed between the second frame 22 and the spring seat panel 51, and shrunk when the piston 42 moves frontward and elongated when the piston 42 moves rearward; and a second spring 53 disposed between the third frame 23 and the spring seat panel 51, and elongated when the piston 42 moves frontward and shrunk when the piston 42 moves rearward.

Figure 4:
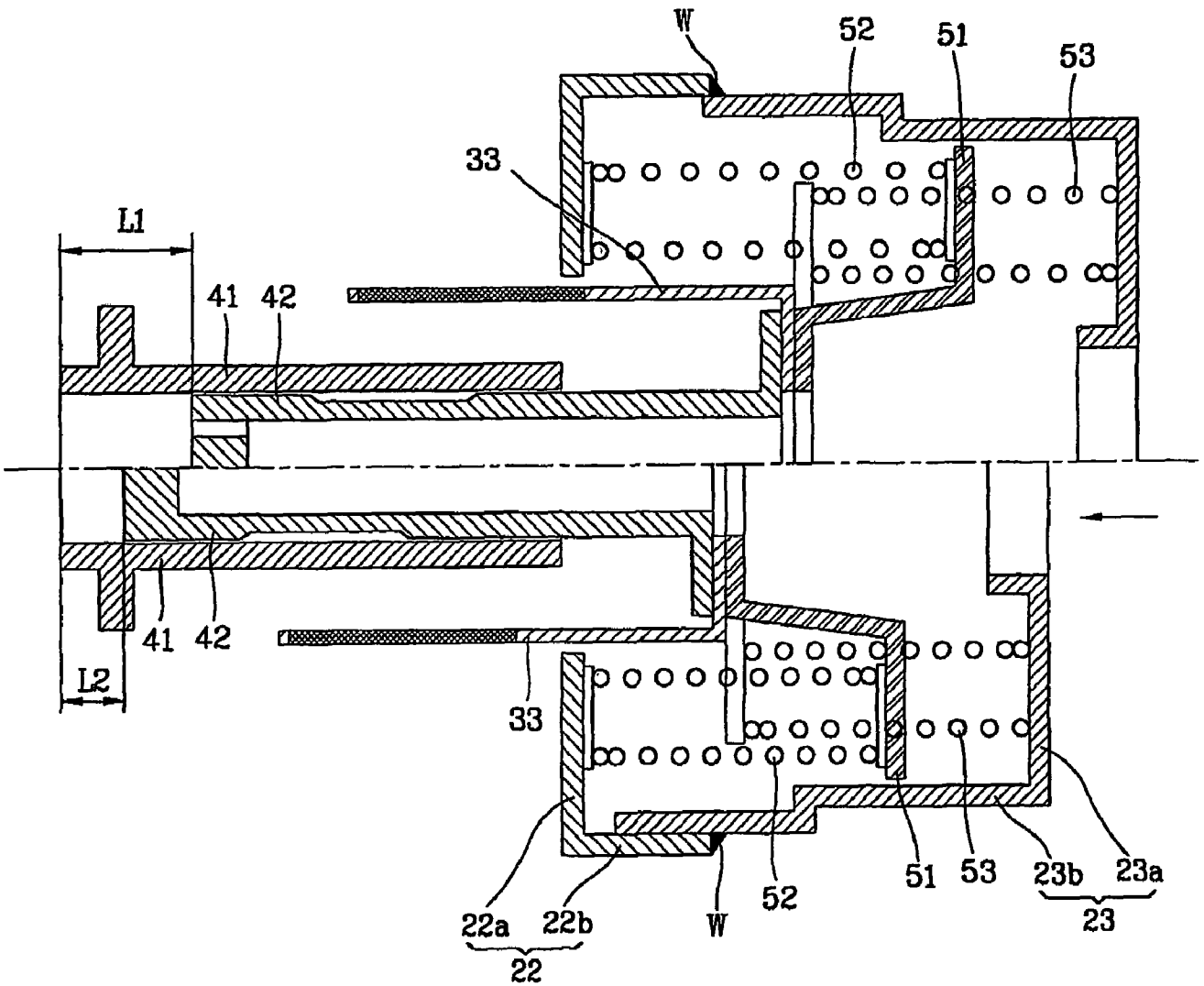
FIG. 4 is a schematic view showing a state of setting an initial location of a piston according to the present invention.

As shown in FIG. 4, the second frame 22 includes a disc shaped first spring supporting portion 22*a* on which an end of the first spring 52 is supported; and a first cylindrical portion 22*b* extended from an outer circumference of the first spring supporting portion 22*a* toward the third frame 23.

The third frame 23 includes a second cylindrical portion 23*b* receiving the first and second springs 52 and 53, and the spring seat panel 51 therein; and a second spring supporting portion 23*a* extended from the rear side of the second cylindrical portion 23*b* inwardly so that an end of the second spring 53 is supported thereon.

The second cylindrical portion 23*b* of the third frame 23 is fixed at the first cylindrical portion 22*b* of the second frame 22, so that an inner circumferential surface of the first cylindrical portion 22*b* and an outer circumferential surface of the second cylindrical portion 23*b* of the third frame 23 are contacted to each other. An end of the first cylindrical portion 22*b* and the outer circumferential surface of the second cylindrical portion 23*b* are engaged to each other by welding (W) so that the second frame 22 and the third frame 23 can be coupled with each other. Herein, the second frame 22 and the third frame 23 may be coupled with each other not by welding but by using a coupling means such as a bolt or the like.

On the other hand, the third frame 23 may not be fixed at the inside of the second frame, but the second frame 22 may be fixed at the inside of the third frame 23 by a press-fit, and, in this case, an end of the second cylindrical portion 23*b* of the third frame 23 and the outer circumferential surface of the first cylindrical portion 22*b* of the second frame 22 are engaged to each other by welding so that the second frame 22 and the third frame 23 can be coupled with each other.

Assembling processes of the reciprocating compressor according to the present invention constructed as above, will now be described.

First, the cylinder 41 is inserted and fixed at the first frame 21, and an inner stator 32 of the reciprocating motor 30 is fixed at an outer circumference of the cylinder 41.

In a state that one side surface of the outer stator 31 disposed at a certain air gap between itself and an outer circumference of the inner stator 32, the second frame 22 is adhered to another side surface of the outer stator 31, and the first and second frames 21 and 22 are fixed using a coupling means. In this manner, the reciprocating motor 30 is fixed between the first and second frames 21 and 22.

And, the magnet paddle 33 coupled with the piston 42 and the spring seat panel 51 is inserted between the outer stator 31 and the inner stator 32 so as to be linearly movable.

At the spring seat panel 51, the first spring 52 and the second spring 53 are mounted. The first spring 52 is adhered to a rear surface of the first spring supporting portion 22*a* of the second frame 22, and the second spring 53 is adhered to a front surface of the second spring supporting portion 23*a* of the third frame 23.

Then, an end of the second cylindrical portion 23*b* of the third frame 23 is slidably inserted at the inner circumferential surface of the first cylindrical portion 22*b* of the second frame 22. Then, while the third frame 23 is being moved in an axial direction of the piston 42, the first and second springs 52 and 53 are fittingly compressed, and an initial location of the piston 42 is fittingly adjusted. That is, as shown in FIG. 4, according to a location of the third frame 23, which has been moved, a location (L1, L2) is fittingly adjusted.

Also, if the location of the piston 42 is optimized, the end of the first cylindrical portion 22*b* of the second frame 22 and the outer circumferential surface of the second cylindrical portion 23*b* of the third frame 23 are welded, thus to terminate assembling of the reciprocating compressor.

In the reciprocating compressor, one of two frames, by which the resonant spring is supported, is movably inserted at the inside of another frame. With this movement of the frame, a location of the piston connected with the resonant spring is adjusted. Since an initial location of the piston can be readily adjusted in this manner, a fabrication process of the reciprocating compressor, and thus its productivity can be improved.

It will be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

The invention claimed is:

1. A reciprocating compressor, comprising:

a reciprocating motor disposed in a casing, and configured to generate a driving force;

a compression unit configured to suck, compress, and discharge gas by the driving force of the reciprocating motor;

a resonant spring unit configured to provide a reciprocating movement of the reciprocating motor with a resonant movement; and at least two spring supporting frames configured to support the resonant spring unit, wherein one of the spring supporting frames is inserted into another of the spring supporting frames, and wherein the at least two spring supporting frames are coupled to each other by welding.

2. The compressor of claim 1, wherein the at least two spring supporting frames comprise:

a first frame configured to support a first spring of the resonant spring unit, which is shrunk in a compression operation of a piston of the compression unit, together with a spring seat panel connected with the piston; and a second frame configured to support a second spring of the resonant spring unit, which is shrunk in a suction operation of the piston, together with the spring seat panel.

3. The compressor of claim 2, wherein the first frame comprises:

a disc shaped first spring supporting portion on which the first spring is supported, and a first cylindrical portion extended from an outer circumference of the first spring supporting portion toward the second frame; and the second frame comprises:

a disc shaped second spring supporting portion on which the second spring is supported, and a second cylindrical portion extended from an outer circumference of the second spring supporting portion toward the first frame, and inserted at an inner circumferential surface of the first cylindrical portion of the first frame.

4. The compressor of claim 3, wherein an end of the first cylindrical portion and an outer circumferential surface of the second cylindrical portion are engaged by welding.

5. The compressor of claim 2, wherein the first frame comprises:

a disc shaped first spring supporting portion by which the first spring is supported, and a first cylindrical portion extended from an outer circumference of the first spring supporting portion toward the second frame; and the second frame comprises:

a disc shaped second spring supporting portion by which the second spring is supported, and a second cylindrical portion extended from an outer circumference of the second spring supporting portion toward the first frame, and wherein the first cylindrical portion is inserted into an inside of the second cylindrical portion.

6. The compressor of claim 5, wherein an end of the second cylindrical portion and an outer circumferential surface of the first cylindrical portion are engaged by welding.

7. A reciprocating compressor, comprising:

a reciprocating motor disposed in a casing, and configured to generate a driving force;

a compression unit configured to suck, compress, and discharge gas by the driving force of the reciprocating motor;

a resonant spring unit configured to provide a reciprocating movement of the reciprocating motor with a resonant movement; and at least two spring supporting frames configured to support the resonant spring unit, wherein one of the spring supporting frames is inserted into another of the spring supporting frames, and wherein the at least two spring supporting frames include:

a first frame configured to support a first spring of the resonant spring unit, which is shrunk in a compression operation of a piston of the compression unit, together with a spring seat panel connected with the piston; and a second frame configured to support a second spring of the resonant spring unit, which is shrunk in a suction operation of the piston, together with the spring seat panel.

* * * * *